United States Patent [19]

Stegall

[11] 4,022,142

[45] May 10, 1977

[54] ICE CUTTER HAVING INJECTION OF LOW DENSITY FLUID

[75] Inventor: Richard D. Stegall, Richardson, Tex.

[73] Assignee: Suntech, Inc., St. Davids, Pa.

[22] Filed: May 14, 1976

[21] Appl. No.: 686,356

[52] U.S. Cl. ..... 114/42

[51] Int. Cl.[2] ..... B63B 35/12

[58] Field of Search ..... 114/40, 41, 42, .5 R; 175/18

[56] References Cited

UNITED STATES PATENTS

| | | | |
|---|---|---|---|
| 3,693,360 | 9/1972 | Holder | 114/40 |
| 3,965,835 | 6/1976 | Bennett | 114/42 |
| R28,332 | 2/1975 | Schirtzinger | 114/42 |

*Primary Examiner*—Trygve M. Blix
*Assistant Examiner*—Jesus D. Sotelo
*Attorney, Agent, or Firm*—J. Edward Hess; Donald R. Johnson; William C. Roch

[57] ABSTRACT

An ice cutting system in which a low density fluid, such as air or exhaust gas, is injected into the cutting region. The injection of the low density fluid results in a more efficient cutting operation, and also reduces the buoyancy of the ice chips resulting from the cutting operation. The reduced buoyancy of the ice chips results in the chips sinking in the slurry surrounding the cutter and being dissipated into the water beneath the surrounding ice.

3 Claims, 2 Drawing Figures

ICE CUTTER HAVING INJECTION OF LOW DENSITY FLUID

BACKGROUND OF THE INVENTION

The present invention relates generally to a system for cutting through ice.

Geologists presently feel that off-shore regions in the Arctic show great promise for the exploration and production of oil and gas. This expectation is bolstered by major gas and oil finds recently made on land in the vicinity of the MacKenzie Delta and Prudhoe Bay, and by the fact that off-short areas are usually more productive than adjacent land areas. When off-shore dtilling operations are conducted in a temperate zone, conventional shallow water drilling methods and production platforms may be employed. However, in view of the extreme cold and harsh conditions which exist north of the Arctic Circle, the drilling and maintenance of off-shore wells in the Arctic has been extremely difficult. Particularly since the Arctic Ocean is covered with an ice sheet for a good portion of the year. The ice sheet may typically be 5 to 6 feet in depth, and an 8 to 10 feet sheet is not uncommon. Further, the Arctic ice sheet is characterized by extreme irregularities resulting from deformations thereof. One form of ice sheet irregularity is called a pressure ridge, which is normally a long narrow section of ice which has built up to be many times thicker than the thickness of the surrounding ice sheet. Pressure ridges sometimes extend 15 feet or more above the surface of the ice sheet and 50 feet or more below the surface. The movement of the ice sheet depends upon its location in the Arctic. At some locations the ice sheet moves only slightly, while at others movements of up to 1 mile per day, at a rate of up to 5 miles per hour, are not uncommon. Under these condition, it is extremely important to protect structures in such an environment from damage due to ice movement. One protection approach has been to cut through the ice as it moves against the structure. In view of the above, it is an object of the present invention to achieve a more efficient ice cutting system.

U.S. Pat. No. Re 28,332 discloses an ice cutting apparatus in which power jets around the circumference of the ice cutter are utilized to power the cutting blades past the ice. However, aside from powering the cutter blades, this patent does not disclose or teach any of the advantages of injecting a low density fluid into the ice cutting region.

SUMMARY OF THE INVENTION

In accordance with a preferred embodiment, there is disclosed a system for cutting ice on water, and designed to cut the ice efficiently and also to cause ice chips resulting from a cut to sink into the water below the ice. The ice cutter includes a system for injecting a fluid having a density less than the density of the water-ice slurry around the cutter, into the region where the cutter contacts the ice. This results in several advantages. The injection of the lower density fluid results in a lower density slurry around the ice cutter, and consequently a lower friction drag on the cutter. The lower friction drag allows a higher cutting velocity which allows the ice chips resulting from the cut to be moved out of the way of the cutter at a faster rate. The rate of removal of ice chips generally limits the rate of ice cutting, and accordingly the higher rate of removal of ice chips allows the ice to be cut at a faster rate. The injection of a low density fluid also reduces the buoyancy of the ice chips such that the ice chips fall into the low density slurry until they are dissipated into the water below the ice surrounding the cutter. In one disclosed embodiment, the low density fluid is air, and in a second embodiment it is the exhaust gases from local engines.

DETAILED DESCRIPTION OF AN EMBODIMENT

Figure 1:
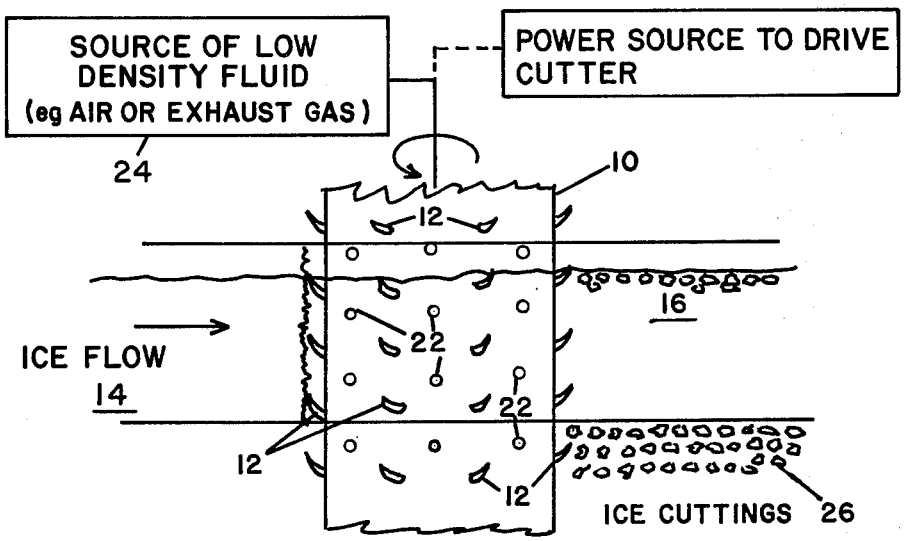
FIGS. 1 and 2 are respectively side and top views of an ice cutter built in accordance with the teachings of the present invention.
Figure 2:
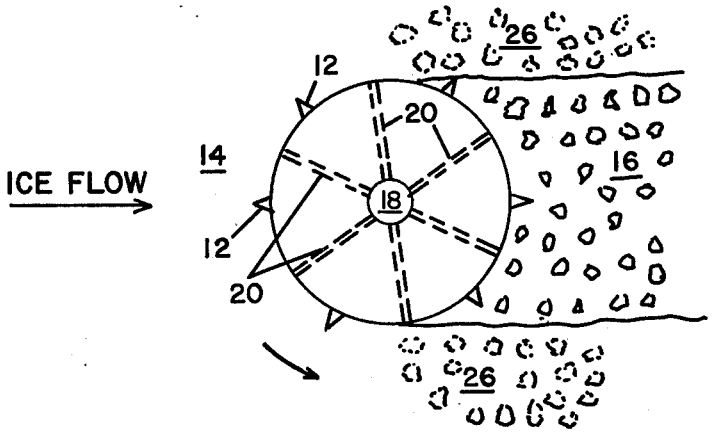

A major problem in the use of mechanical ice cutters is the disposal of the ice cuttings, which tend to clog the mechanical cutter if not removed. Two methods of removal are possible. In one method the cuttings are lifted up and onto the surface of the ice sheet. This lifting process requires energy which results in an overall decrease in the cutter efficiency. Also, the presence of the cuttings on the ice surface reduces safety since the terrain produced by the cuttings presence is extremely rough. If the direction of ice movement changes due to tides, winds, etc., and the cutters are stopped, the only immediate access to the ice would be over the mounds of cuttings. In a second method, the cuttings are deposited under the ice. This method does not produce rough terrain caused by the presence of ice cuttings on the surface. Also, energy is required to overcome the buoyancy of the cuttings so they may be deposited under the ice, which results in a decrease of the efficiency of the overall system.

The present invention deposits the cuttings under the ice in a very energy efficient manner by injecting a low density fluid (lower than the surrounding medium of water-ice slurry) between the cutting members. The low density fluid reduces the overall density of the surrounding medium, and thereby reduces the buoyant force on the cuttings. The energy required to deposit cuttings under the ice then decreases since the buoyant force which must be overcome is decreased.

The present invention also results in several additional advantages. In ice cutting equipment the rate of removal of cut material from the channel generally limits the cutting rate as the amount of ice cut cannot be greater than the amount of ice removed or the cutter will clog. Further, the ice that has been cut is removed from the channels between the cutting members at a rate proportional to the cutting blade tangential velocity. The frictional drag of the slurry determines the cutting blade tangential velocity and hence the cutting rate of the ice. The frictional drag is, in general, a direct function of the slurry density. One advantage of the present invention is that it reduces the frictional drag of the slurry in the channels between the cutting members. This increases the cutting velocity and volumetric flow rate of cut material out of the channels, and thereby increases the possible maximum cutting rate.

A simple verification can be made using the homogeneous model for multiphase flow. The mean density of the slurry can be expressed as $$p_m = \alpha\, p_2 + (1-\alpha)\, p_1$$

where $p_m$ = means density of the slurry $p_1$ = density of the solid phase
$p_2$ = density of the liquid phase
$\alpha$ = volume fraction
The volume fraction is expressed as $$\alpha = \frac{(p_m - p_1)}{(p_2 - p_1)}$$

For a slurry of fluid and solids, the mixture viscosity may be expressed as $u = u_1 (1 + 2.5\alpha)$;
$u_1$ = fluid viscosity The equation for viscosity can be written now as $$u = u_1 \left\{ 1 + 2.5 \left( \frac{p_m - p_1}{p_2 - p_1} \right) \right\}$$

For the laminar flow case on a flat surface $$T_w = u \left( \frac{dv}{dy} \right)_c$$

Where
$T_w$ = shear stress at the cutting member
$u$ = mixture viscosity (slurry)

$\left( \frac{dv}{dy} \right)_c$ = velocity gradient of the slurry

And based on the homogeneous multiphase flow model $$\frac{dp}{dz} = \frac{P}{A} T_w$$

The terms are
$dp/dz$ = pressure drop
$P$ = channel perimeter
$A$ = channel area
Then we have $$\frac{dp}{dz} = \frac{Pu_1}{A} \left\{ 1 + 2.5 \left( \frac{p_m - p_1}{p_2 - p_1} \right) \right\} \left( \frac{dv}{dy} \right)_c$$

From this equation it may be seen that the pressure drop can be minimized by minimizing $p_m$. This in turn maximizes the volumetric flowrate of slurry from the channels between the cutting members, and also allows higher cutting rates for a given input power or lower power supplied for a given cutting rate.

Referring now specifically to FIG. 1, there is illustrated a cut-away view of a shaft 10 having a plurality of ice cutting edges in the form of teeth 12 attached around its circumference. The ice cutting teeth are illustrated schematically, and for the purpose of this invention the particular shape of the cutting edges is not important. As an ice flow 14 occurs relative to the cutting shaft, ice moves against the revolving teeth 12, and the teeth 12 chip away at the ice resulting in ice cuttings.

To enable the practice of the present invention, the shaft 10 has a hollow center at 18 which communicates through radially extending passageways 20 with a plurality of apertures 22 around the circumference of the cutting shaft and spaced in between the cutting teeth. The hollow center 18 is in communication with a source of low density fluid 24 which, during the cutting operation, supplies to it low density fluid under pressure. The low density fluid then flows through the radially extending passageways 20 and discharges through the apertures 22 into the slurry around the cutting wheel. The low density fluid may be, by way of example, air or exhaust gases from on-board engines. The utilization of exhaust gases would help prevent ice from freezing on the cutting surfaces during the cutting operation and also during quiescent periods. In alternative embodiments, the low density fluid might be injected at other locations along the cutting shaft. Also, the present invention is not limited to cutting shafts, and the teachings of this invention may be utilized with other types of cutters and cutting surfaces, such as chain cutters.

With the low density fluid injected into the slurry, the ice cuttings lose buoyancy and many drop below the level of the ice and are pushed out and under the sides along the cut channel, as illustrated at 26. This results in a removal of the ice cuttings underneath the ice, with all of the advantages mentioned earlier. Further, the mechanical efficiency of the ice cutting system should rise substantially for the reasons given previously.

Although at least one embodiment of the present invention has been described, the teachings of this invention will suggest many other embodiments to those skilled in the art.

The invention claimed is:

1. An ice cutting system for cutting ice on water and adapted to cut the ice efficiently and also to cause resulting ice chips to sink into the water below the ice and comprising:

a. an ice cutter for cutting away ice chips from ice on water, and including a mechanical power means for driving said cutter past the surface of the ice to chip away at the ice; and b. means, including apertures in the ice cutter and not including said mechanical power means, for injecting through said apertures a fluid, having a density less than the density of the water-ice slurry around the cutter, into the region where the cutter contacts the ice, whereby the resulting lower density of fluid in that region results in a more efficient cutting operation and also results in the ice chips sinking in the lower density slurry around the cutter until they are dissipated into the water beneath the ice.

2. An ice cutting system as set forth in claim 1 wherein said means for injecting a fluid includes means for injecting air into the region the cutter contacts the ice.

3. A system as set forth in claim 1 wherein said means for injecting a fluid includes means for injecting hot exhaust gases into the region the cutter contacts the ice.

* * * * *